United States Patent [19]

Garron

[11] 4,138,955

[45] Feb. 13, 1979

[54] STITCH LENGTH CONTROL FOR ELECTRONIC SEWING MACHINE

[75] Inventor: Stephen A. Garron, Elizabeth, N.J.

[73] Assignee: The Singer Company, New York, N.Y.

[21] Appl. No.: 882,009

[22] Filed: Feb. 28, 1978

[51] Int. Cl.[2] ..... D05B 27/22; D05B 3/02

[52] U.S. Cl. ..... 112/158 E; 112/221

[58] Field of Search ..... 112/158 E, 158 R, 203, 112/121.11, 221

[56] References Cited

U.S. PATENT DOCUMENTS 3,433,190 3/1969 Sagi ..... 112/158 R 3,987,739 10/1976 Wurst et al. ..... 112/158 E 4,016,821 4/1977 Minalga ..... 112/158 E

*Primary Examiner*—Peter Nerbun

*Attorney, Agent, or Firm*—William V. Ebs; Robert E. Smith; Edward L. Bell

[57] ABSTRACT

An electronic sewing machine with pattern selecting means is provided with control circuitry operable to increase stitch lengths in the work feeding direction by a predetermined integral multiple in a selected pattern by providing for pattern data retention and the discontinuance of endwise needle reciprocation during work feed operations corresponding in number to the said predetermined integral multiple.

6 Claims, 4 Drawing Figures

STITCH LENGTH CONTROL FOR ELECTRONIC SEWING MACHINE

BACKGROUND OF THE INVENTION

1. Field of the Invention

The invention relates to electronic sewing machines capable of forming selected stitch patterns automatically.

2. Description of the Prior Art

It is known to provide a sewing machine with mechanical control means which an operator can utilize to modulate the length of travel of the feed dog during successive needle penetrations of work being sewn, thereby enabling him to increase stitch length. It is also known as disclosed in U.S. Pat. No. 3,433,189 which is assigned to the same assignee as the present invention to provide skip stitch mechanism in zig-zag machines for interrupting the endwise reciprocation of the sewing needle at predetermined intervals dependent upon the contour of control cams. However, recently developed electronic machines lack a control enabling an operator to increase by an integral multiple the length of the stitches of any one of a plurality of electronically stored patterns and it is a prime object of this invention to meet such need.

SUMMARY OF THE INVENTION

In accordance with the invention, an electronic sewing machine with means for electronically storing pattern data subject to recall by timing pulses related to needle reciprocation is provided with control circuitry which when connected to an address counter associated with the memory and to latching mechanism associated with needle reciprocating means provides control signals thereto effective to repetitively suspend for an integral number of timing pulses the recall from the memory of new bight and feed control data and also endwise reciprocation of the sewing needle while work feeding operations pursuant to address data are maintained to extend stitch lengths by an integral multiple in the work feeding direction.

DESCRIPTION OF THE PREFERRED EMBODIMENT

This invention is adapted to be applied to any sewing machine having an ornamental stitch pattern system operating in response to electronic pattern information signals. U.S. Pat. No. 3,872,808, Mar. 25, 1975 of John W. Wurst, which discloses one sewing machine of this type is incorporated herein by reference.

Figure 2:
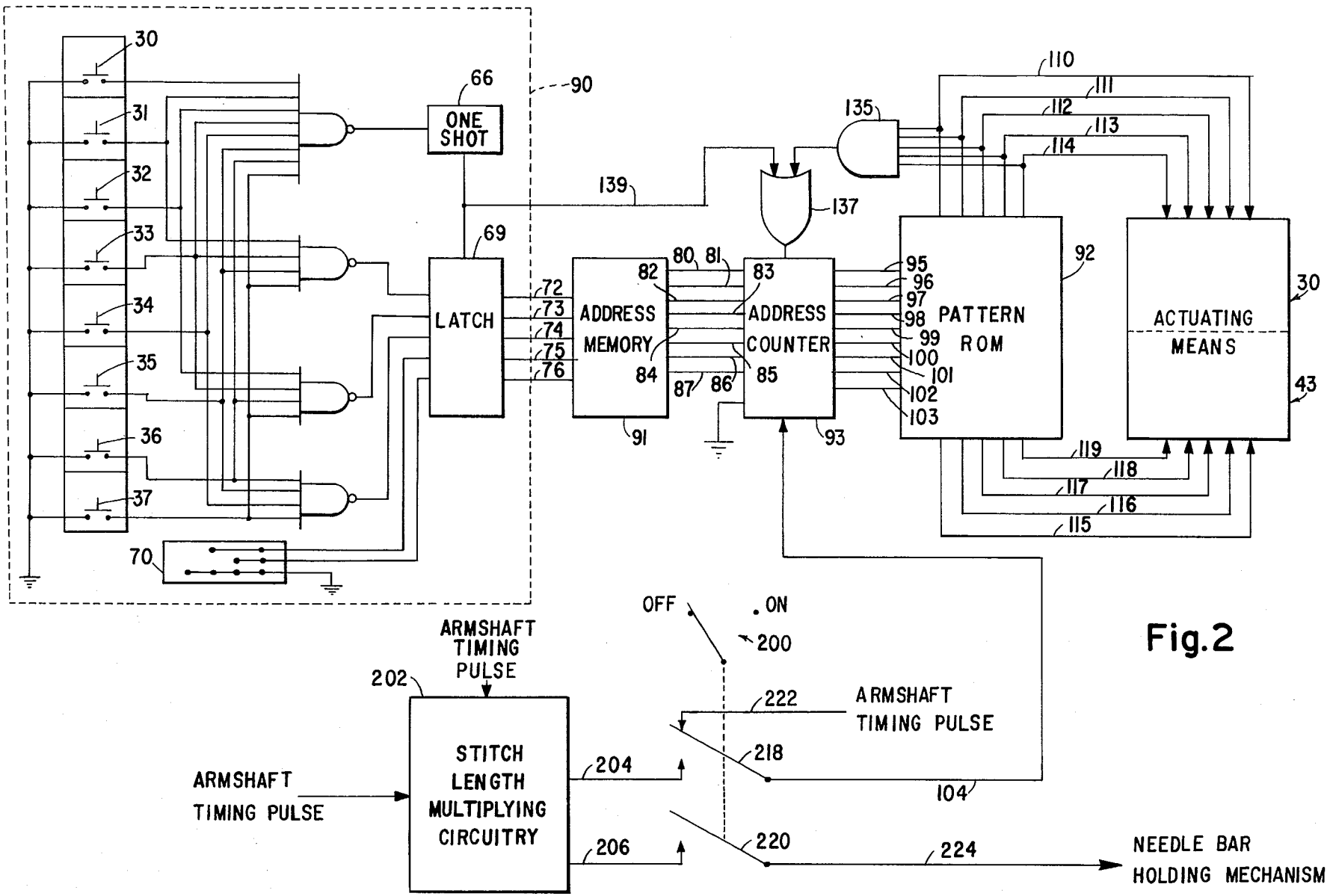
FIG. 2 is a logic diagram showing an ornamental sewing machine stitch pattern system operative in response to electronic signals and including the stitch lengthening control arrangement of the invention.

The logic diagram illustrated in FIG. 2 includes each of the elements disclosed in FIG. 2 of the U.S. Pat. No. 3,872,808, referred to above and in addition, includes additional elements to provide for a greater selection of patterns as well as stitch lengthening control means in accordance with the invention.

Figure 1:
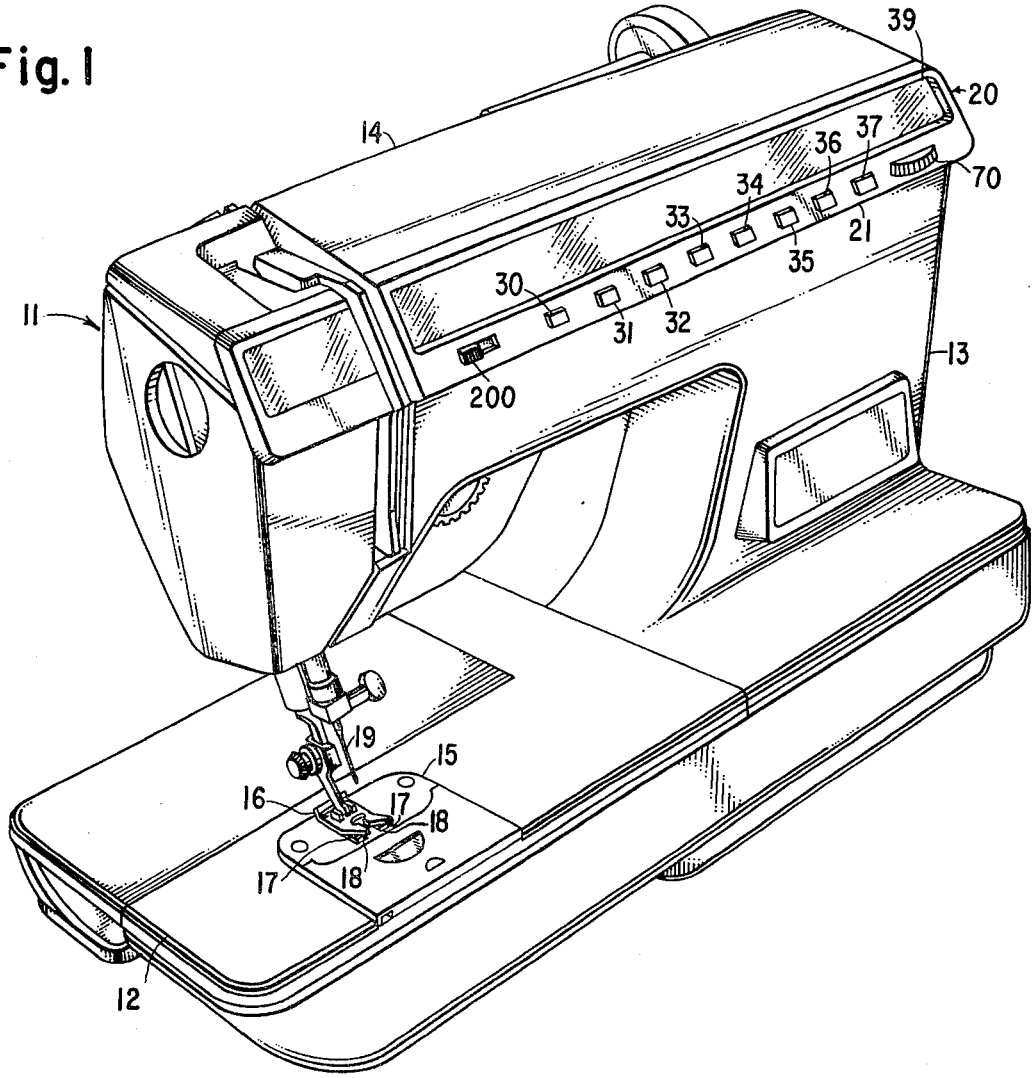
FIG. 1 is a front perspective view of a sewing machine to which the invention has been applied.

Referring to FIG. 1 of the drawings, 11 indicates a sewing machine frame including a work supporting bed 12 from which rises a standard 13 that supports a bracket arm 14 overhanging the bed. A throat plate 15 carried on the bed supports the thrust of a spring loaded presser device 16 carried in the bracket arm. Work fabrics to be stitched are urged by the presser device 16 downwardly against the throat plate and against a work feed dog 17 which works upwardly through slots 18 in the throat plate to feed the work. The throat plate 15 is also apertured to accommodate reciprocation and lateral jogging of a needle 19 carried in the bracket arm.

The bracket arm of the sewing machine is preferably fitted with a control assembly 20 which may be constructed in accordance with that disclosed in the U.S. Pat. No. 3,915,506, of Adams, et al, issued Oct. 21, 1975, and such patent is incorporated herein by reference. As shown, the control assembly includes an escutcheon plate 21 through which a plurality of pattern selection buttons 30 to 37 protrude, and a transparent insert 39 through which indicia in close association with the selector buttons is visible. A switch 200 is also provided to protrude through the escutcheon plate 21 for use in manually controlling the stitch length multiplying means of the invention.

Referring now to FIG. 2 and briefly reviewing features of the logic diagram of FIG. 2 which remain substantially unchanged from those of the disclosure of U.S. Pat. No. 3,872,808, pattern selector means 90, depending upon the setting of a switch 70 and depending upon which pattern selection button is depressed, results in appearance of a selected digital code signal continuously on output lines 72, 73, 74, 75 and 76 from the latch 69 and also results in a pulse being generated in the line 139 from the one shot 66. In the address memory 91, the digital code signal on lines 72 to 76 results in an output on lines 80 to 87 which continuously defines the starting word address of a group of consecutive word addresses in the Pattern ROM 92 constituting a stitch pattern. The address counter 93 is responsive to pulses on the line 104 consecutively to increase the address appearing on lines 95 to 103 leading to the ROM 92. A pulse from NOR gate 137 in output line 138 leading to the address counter is required to reset the counter to the starting word address appearing on lines 80 to 87 and as disclosed in U.S. Pat. No. 3,872,808, this is occasioned either by a pulse in line 139 resulting from selection of a new pattern or upon the appearance of a special end-of-pattern code word on bight output lines from ROM 92, that is the lines 110 to 114 extending to an AND gate 135 the output of which is an input to NOR gate 137. The bight output lines 110 to 114 and the lines 115 to 119 which are feed output lines from ROM 92 lead to bight and feed actuating means 30 and 43 respectively.

Figure 3:
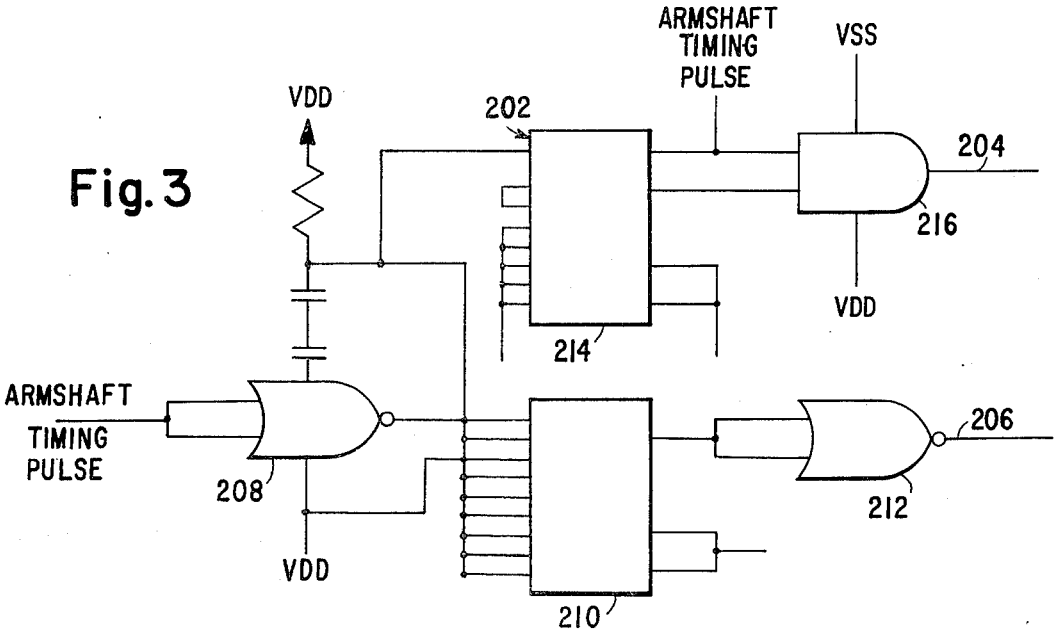
FIG. 3 is a logic diagram of stitch lengthening control circuitry according to the invention.

Stitch length multiplying circuitry 202 (see FIGS. 2 and 3) according to the invention, with output lines 204 and 206, includes NOR gate 208, counter 210, NOR gate 212 counter 214 and AND gate 216. Lines 204 and 206 extend to switch contact arms 218 and 220 respectively operable by on-off switch 200 (see FIG. 1). Assuming switch 200 is moved from its normal illustrated position to a stitch lengthening on-position, contact arm 218 is disconnected from line 222 supplying an arm shaft timing pulse to line 104, and is moved to a position connecting output line 204 of the stitch length multiplying circuitry with line 104. Contact arm 220 is moved to a closed position connecting output line 206 to a line 224 leading to needle latching mechanism hereinafter described.

During normal operation of the sewing machine with switch 200 in the off-position, the sewing machine will produce continuously repeated stitch groups of whichever pattern of stitches has been selected by actuation of the switch 70 and one of the pattern selector buttons 30 to 37. The selection of any one stitch pattern will operate the latch 69 causing the address memory 91 to output on lines 80 to 87 the address of the first word of the selected pattern in the ROM 92. As the sewing progresses the address counter will consecutively advance in response to arm shaft timing pulses fed to the address counter 93 over switch arm 218 from the first word until, as explained in U.S. Pat. No. 3,872,808 incorporated herein by reference, an end-of-pattern code word is reached, which for instance, may be the binary code 11111 at the bight output lines 110 to 114. The AND gate 135 will respond to such end-of-pattern code word and by way of OR gate 137 load or reset the address counter 93 back to the first word of the pattern. By this arrangement, the selected stitch pattern will be repeated continuously.

Assuming that switch 200 is moved from its normal illustrated position to the stitch lengthening position to connect lines 204 and 206 of the stitch lengthening control circuitry via line 104 and 224 to address counter 93, and needle latching mechanism, the manner in which the stitch lengthening circuitry operates to increase stitch length will now be described.

NOR gate 208 of the stitch length multiplying circuitry alternately receives low and high arm shaft timing pulses related to reciprocations of the sewing needle and in response produces high and low output signals respectively which are fed to counter 210. The counter 210 which may be purchased commercially from RCA Corporation as Model CD4029 is programmed in a conventional manner so as to cause it to successively produce one low output signal in response to each of an integral number of low input signals such as two, three, four etc. The low output signals of counter 210 are fed to NOR gate 212 and such NOR gate 212 converts the low counter signals to highs which are then fed to the needle latching mechanism over line 206, contact arm 220 and line 224.

A counter 214 which is a duplicate of the counter 210, is programmed and connected to counter 210 so as to produce a high output signal whenever counter 210 produces a low output signal in response to an integral number of low input signals from NOR gate 208. Such high output signals of counter 214 are fed to an AND gate 216 which also receives input arm shaft signals and is caused upon the occurrence of a high output signal from counter 214 to produce a high output signal in line 204 which is then fed over contact arm 218 and line 104 to address counter 93.

The high signals produced in line 204 and the simultaneous high signals produced in line 206 are evenly spaced pulses separated by time intervals which are an integral multiple of the interval between the low arm shaft timing pulses fed to NOR gate 208. Between the simultaneous highs in lines 204 and 206, low signal pulses are generated in lines 204 and 206 respectively in response to arm shaft rotation. While high signals to counter 93 advance the counter and cause stitches to be sewn according to the selected pattern, the lows fail to advance the counter. Furthermore the first low signal to counter 93 after a high causes the needle latching mechanism to disconnect the needle bar from the drive therefor and move it into a raised position where it is held to prevent the formation of a stitch until the low changes to a high. During the period in which low input signals are fed to counter 93, the particular code words determining needle bight and feed remain the same as determined by the last code word addressed in response to a high signal and the machine feeds without forming stitches. When a high signal is produced in lines 204 and 206 the counter 93 is advanced and the needle latching mechanism is actuated in a manner causing the needle bar to be reconnected to the needle bar drive. A stitch is formed with a bight determined by the advance of the counter and newly selected code word for bight, and after the formation of such stitch the machine feeds through a distance determined by the advance of the counter and a newly selected code word for feed. Stitches in the selected pattern formed in the described manner are necessarily a predetermined integral number of times longer in the feeding direction than normal, by the multiplication factor determined by the counters 210 and 214.

Figure 4:
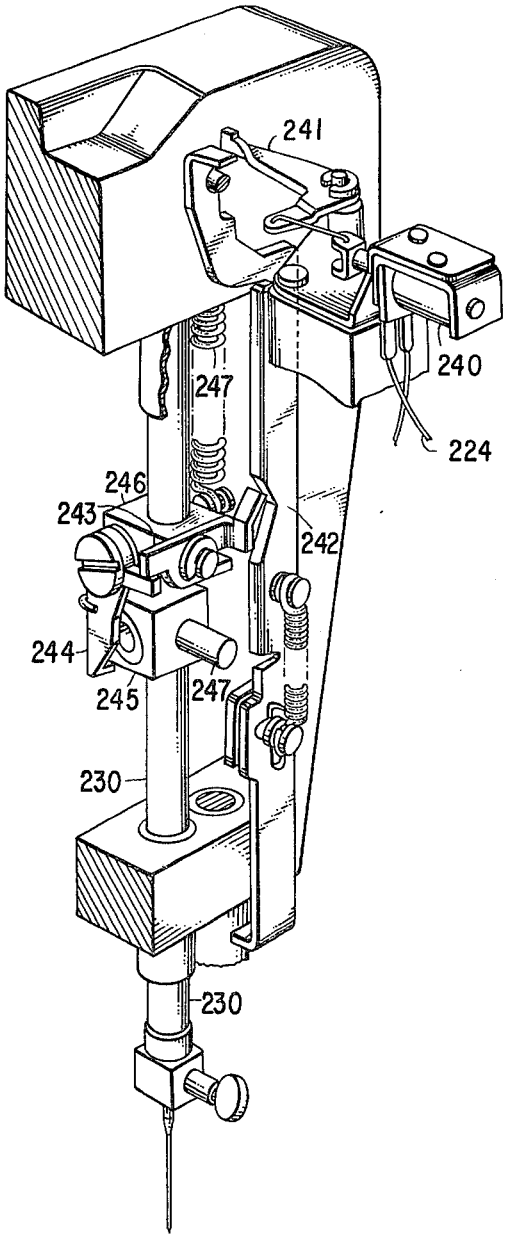
FIG. 4 is a perspective view of a needle bar mechanism operatively associated with the control circuitry of FIG. 3.

The needle latching mechanism is preferably of the kind shown and described in U.S. Pat. No. 3,872,809 which is incorporated herein by reference. Such needle latching mechanism (shown in FIG. 4) includes a solenoid 240 which in response to a low signal shifts mechanical linkages including a bell crank 241, an elongated latch release member 242, and pivoted latch members 243 and 244 to uncouple a needle bar reciprocating block 245 from a collar 246 which is fixed to the needle bar 230. A spring 247 causes the needle bar to rise to the top of its stroke when block 245 and collar 246 are uncoupled and the needle bar remains in such position until a high signal is fed to solenoid 240. Solenoid 240 responds to a high signal by shifting the said linkages including bell crank 241, latch release member 242 and the latch members 243 and 244 in a manner causing needle bar reciprocating block 245 to be coupled to collar 246 on the needle bar 230 and the needle bar to be reciprocated by drive linkage (not shown) connected to block 245 through shaft 247.

It is understood that various changes in and modifications of the embodiment of the invention illustrated and described herein may be made without departing from the spirit and scope of the invention, and the annexed claims are intended to cover all such variations.

Having thus set forth the nature of the invention, what is claimed herein is:

1. A sewing machine with needle reciprocating means, needle bight actuating means and feed actuating means for use in forming a succession of stitches individually placed in a selected pattern, said sewing machine including:

a. static memory means in which a multiplicity of separate digital code words for controlling the needle bight actuating means and feed actuating means are stored in a predetermined sequence;

b. pattern controlling switch means accessible to a sewing machine operator and effective to impress on said static memory a signal identifying as a starting word in a pattern a specific one of said multiplicity of separate digital code words which correspond to individually placed stitches;

c. means for producing timing pulses related to the operation of the needle reciprocating means;

d. stitch lengthening switch means;

e. an address counter coupled to the static memory and responsive to the timing pulses in one position of the switch means for successively addressing the digital code words in said memory in said predetermined sequence beginning with said starting word identified by the pattern controlling switch means and thereby causing the needle to assume a bight position and work to be fed according to the addressed code words such that stitches may be formed according to the selected pattern as the needle is moved into and out of the work by the reciprocating means;

f. control circuitry connected to the address counter and responsive to said timing pulses in another position of the stitch lengthening switch means for limiting pulses controlling advances of the address counter to evenly spaced pulses separated by time intervals which are an integral multiple of the interval between the said timing pulses;

g. latching means operatively connected to said control circuitry and effective with the stitch lengthening control switch means in said another position to prevent needle reciprocation except in response to the said evenly spaced pulses which cause stitches to be formed in work being sewn.

2. The combination of claim 1 wherein said control circuitry, when the stitch lengthening switch means is in said another position, produces the said evenly spaced control pulses with intervening time intervals which are twice as long as the intervals between the timing pulses.

3. The combination of claim 1 wherein said control circuitry includes counter means responsive to the timing pulses and operatively connected to the address counter and latching means for producing pulses with intervening time intervals which are an integral multiple of the interval between said timing pulses.

4. The combination of claim 3 wherein the counter means includes a counter operatively connected to the address counter and a counter operatively connected to the latching means, said counters each being effective to produce output pulses with intervening time intervals which are an integral multiple of the intervals between said timing pulses.

5. The combination of claim 1 wherein the control circuitry connects to and disconnects from the address counter at contacts of the stitch lengthening switch means.

6. The combination of claim 1 wherein the stitch lengthening switch means is a two position device having an on and off position.

* * * * *